US008586888B2

(12) United States Patent
Ford et al.

(10) Patent No.: US 8,586,888 B2
(45) Date of Patent: Nov. 19, 2013

(54) FLOTATION DEVICE SAFETY LIGHT SWITCH

(75) Inventors: Timothy D. F. Ford, Beaconsfield (CA); Stéphane Gascon, Mascouche (CA); Steve Roumeliotis, Beaconsfield (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 209 days.

(21) Appl. No.: 13/178,825

(22) Filed: Jul. 8, 2011

(65) Prior Publication Data

US 2012/0006663 A1 Jan. 12, 2012

Related U.S. Application Data

(60) Provisional application No. 61/362,411, filed on Jul. 8, 2010.

(51) Int. Cl.
*H01H 9/00* (2006.01)

(52) U.S. Cl.
USPC ..... 200/313; 200/61.05; 441/89

(58) Field of Classification Search
USPC ..... 200/313, 61.05, 506; 73/293, 313; 340/618, 623; 441/80, 89, 136
See application file for complete search history.

(56) References Cited

U.S. PATENT DOCUMENTS

| | | | | |
|---|---|---|---|---|
| 5,034,847 A | | 7/1991 | Brain | |
| 5,059,952 A | | 10/1991 | Wen | |
| 5,235,337 A | | 8/1993 | Clark et al. | |
| 5,237,491 A | | 8/1993 | McCarter | |
| 5,452,189 A | * | 9/1995 | Alkj r | 362/253 |
| 5,921,656 A | | 7/1999 | Flood et al. | |
| 7,195,369 B2 | * | 3/2007 | Shaw | 362/108 |
| 2007/0153504 A1 | | 7/2007 | Thornhill | |
| 2007/0205905 A1 | | 9/2007 | Ford et al. | |

FOREIGN PATENT DOCUMENTS

| | | | |
|---|---|---|---|
| EP | 1679258 | A2 | 7/2006 |
| WO | 2010003246 | A1 | 1/2010 |
| WO | 2010037842 | A1 | 4/2010 |

OTHER PUBLICATIONS

ACR Electronics, Inc. RapidFire TM Strobe, URL: http://www.acrelectronics.com/media/products/1629/1342011162549460/3961.pdf, Mar. 2010.
International Search Report of PCT/CA2011/050418, Sep. 21, 2011.

* cited by examiner

*Primary Examiner* — Vanessa Girardi
(74) *Attorney, Agent, or Firm* — Goudreau Gage Dubuc Hugh Mansfield

(57) ABSTRACT

A safety device for attachment to a flotation device is disclosed comprising a light source, a housing, an actuator mounted within the housing and slideable between a first position wherein the light source is not illuminated and a second position wherein the light source is illuminated. The actuator further comprises a raised boss engageable from outside of the housing, a lanyard at least a portion of which is outside of the housing and a water activated switch wherein when the device is submerged in water, the water activated switch completes an electrical circuit illuminating said light source. The lanyard is releasably connected to an end of the actuator using a separable interconnection assembly. When the lanyard is pulled, the actuator moves from the first position to the second position and on reaching the second position the separable interconnection assembly separates thereby disengaging the lanyard from the actuator. An electrical circuit is completed illuminating the light source and the actuator may be reversed from the second position back into the first position using the raised boss thereby extinguishing the light source.

14 Claims, 10 Drawing Sheets

FLOTATION DEVICE SAFETY LIGHT SWITCH

CROSS REFERENCE TO RELATED APPLICATIONS

This application claims benefit, under 35 U.S.C. §119(e), of U.S. provisional application Ser. No. 61/362,411, filed on Jul. 8, 2010, which is incorporated herein in its entirety by reference.

FIELD OF THE INVENTION

The present invention relates to a safety switch that is activated in a multiplicity of manners. In particular, the present invention is concerned with an electronic switch for search and rescue equipment that is activated by contact submersion in water, by a finger operated actuator and through pulling a lanyard.

BACKGROUND OF THE INVENTION

Water survival equipment such as life rafts and life vests are normally outfitted with switch activated lights, beacons or other forms of electronic life saving devices designed to assist in the search for and provision of aid to people who are in distress or imminent danger, particularly during water search and rescue operations. However, such life saving devices are only effective if activated, which may be accomplished by a user manually engaging a switch to supply electric power to the electronic life saving device. During the course of precarious and dangerous situations, for example a person being cast overboard with the onset of wave action, darkness, unconsciousness, or hypothermia, manual activation of a switch by such a person may be difficult and thereby jeopardize a successful search and rescue.

There exists in the prior art several manners which ensure such devices are thrown to activate electronic life saving devices. For instance, the use of water activated switches to engage life saving devices during water survival situations whereby the switch is automatically activated when entered into contact with water is well known in the art. Similarly, the use of a water activated switch with a manual over-ride to supplement activation and act as a backup measure should the water activated switch fail is also well known in the art.

One drawback of these prior art devices is that while they allow for automatic activation of a switch, they do not provide for a manual means to deactivate the device once it has been activated to thereby ensure the battery to the life saving device is preserved, for example, during daytime when the light is less visible, or to activate the switch there afterwards when the signaling light is more visible.

Furthermore, these prior art devices do not provide the flexibility of having a multiplicity of manners in which a switch may be activated and deactivated to therefore account for a variety of precarious and dangers situations.

SUMMARY OF THE INVENTION

In order to address the above and other drawbacks, there is provided a safety device for attachment to a flotation device comprising a light source, a housing, an actuator mounted within the housing and slideable between a first position wherein the light source is not illuminated and a second position wherein the light source is illuminated, the actuator further comprising a raised boss engageable from outside of the housing, and a lanyard at least a portion of which is outside of the housing, the lanyard releasably connected to an end of the actuator using a separable interconnection assembly, and a water activated switch. When the lanyard is pulled, the actuator moves from the first position to the second position and on reaching the second position the separable interconnection assembly separates thereby disengaging the lanyard from the actuator and an electrical circuit is completed illuminating the light source, and wherein the actuator may be reversed from the second position back into the first position using the raised boss thereby extinguishing the light source.

Other objects, advantages and features of the present invention will become more apparent upon reading of the following non-restrictive description of specific embodiments thereof, given by way of example only with reference to the accompanying drawings.

DETAILED DESCRIPTION OF ILLUSTRATIVE EMBODIMENTS

The present invention is illustrated in further details by the following non-limiting examples.

Figure 1:
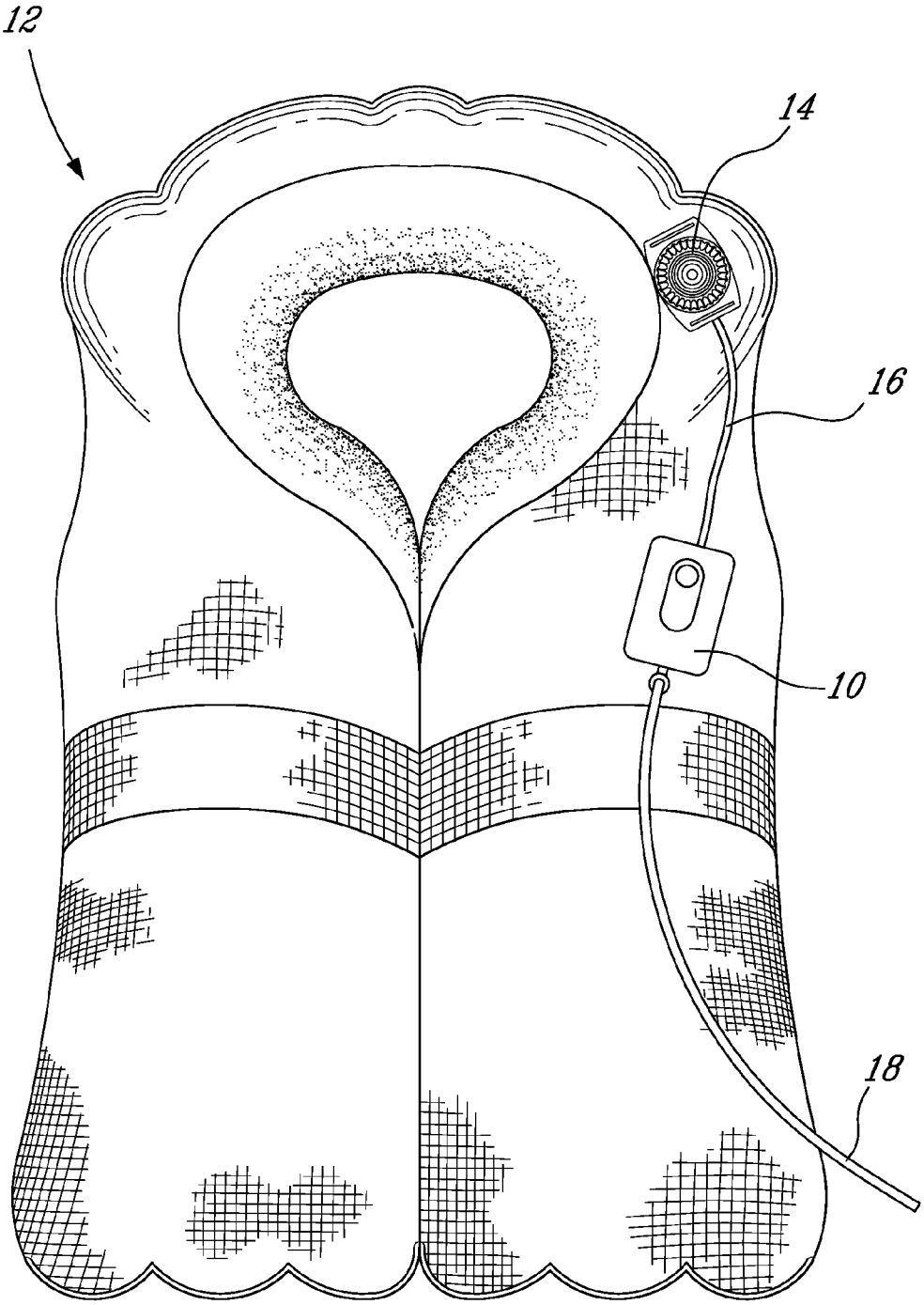
FIG. 1 is a front view of a life vest comprising a light with a safety switch connected thereto according to an illustrative embodiment of the present invention.

Referring to FIG. 1, a switch in accordance with an illustrative embodiment of the present invention and generally referred to using the reference numeral 10, will now be described. The switch 10 is generally attached to a life saving flotation device 12, such as a life vest, life raft or the like, and is connected to a light 14 or any other electronic apparatus that requires switching control via a pair of wires 16. In the present illustrated embodiment, the electronic apparatus comprises a light 14 comprising light emitting elements housed within the light 14 and driven by electronics and a battery sealed within a light encasing therein. The switch 10 may also be used in conjunction with a life raft, a life suit, or any other form of life saving device 12 to which the switch 10 may be affixed. In the present illustrated embodiment, the switch 10 is attached to a life vest 12 at a point where the switch 10 is easily accessed and manipulated by a user, or the wearer of the life vest 12, for its activation. Additionally, the switch 10 may further be attached to a life raft or vessel via a lanyard or rigging 18 for activation in a manner described herein below. Upon throwing of the switch 10 by any of the multiplicity of manners herein described to activate the light 14, which generally entails electrically connecting the two wire leads 16 to form a closed circuit, power is supplied to the light 14 thereby illuminating it for the purpose of signaling the location of the wearer to any nearby search and rescue team.

Figure 2:
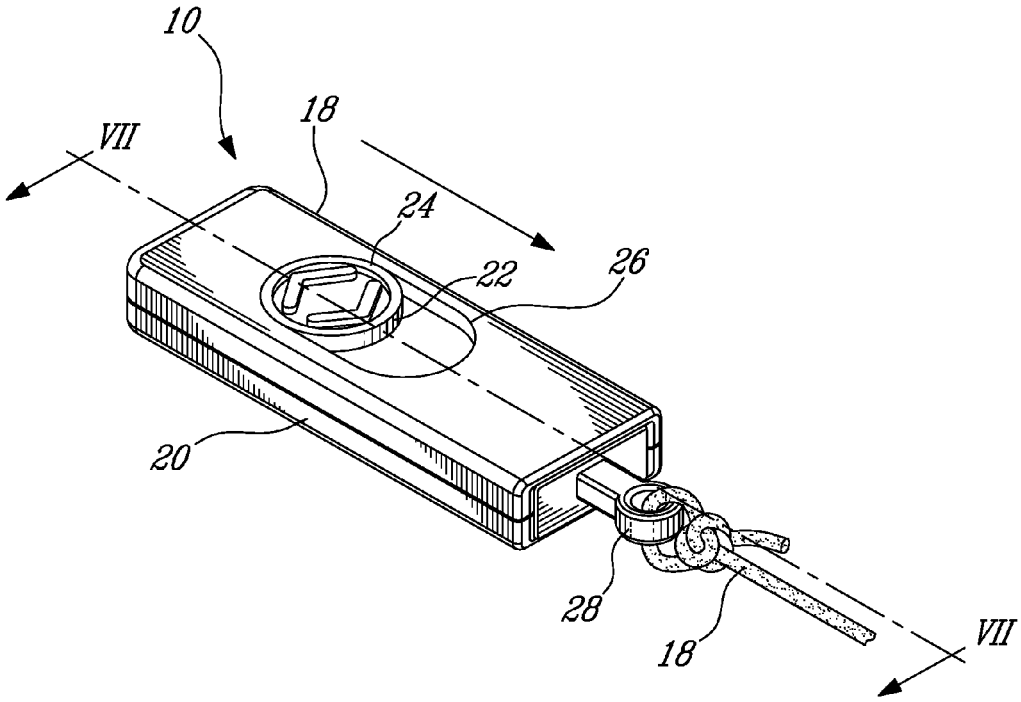
FIG. 2 is an orthonormal view of the safety switch of FIG. 1 connected to a lanyard.

Referring to FIG. 2, the switch 10 illustratively comprises a housing 20 encompassing an actuator 22 further comprising a raised boss 24 such as a thumb knob which protrudes from the housing 20 through an aperture 26, and a separable interconnection assembly 28 to which a lanyard 18 is attached. The thumb knob 24 is illustratively embossed with a chevron like gripping surface for providing traction to a user's thumb or finger.

Figure 3:
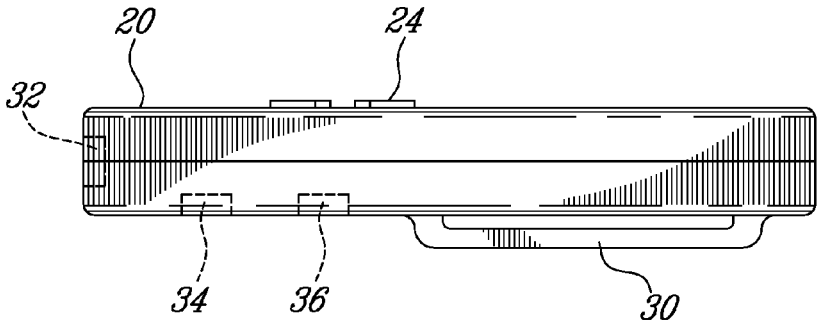
FIG. 3 is a side view of the safety switch of FIG. 1.

Referring to FIG. 3 in addition to FIG. 2, the rear of the housing 20 illustratively comprises an attachment means 30, a wire aperture 32 through which the electrical wires 16 enter the housing 20, as well as a pair of water access apertures/holes 34, 36 through which water may enter (and leave) the housing 20. The attachment means 30 is illustratively located on the rear side of the housing 20 for securing the switch 10 to a belt, a tie, a fabric or a mounting point of a life vest or any other type of life saving equipment. As will be apparent to a person skilled in the art, although a clip has been shown for illustrative purposes, any type of attachment means 30 (e.g. Velcro, a snap, adhesive) suitable for securing the switch 10 to a life saving device 12 may be employed.

Figure 4:
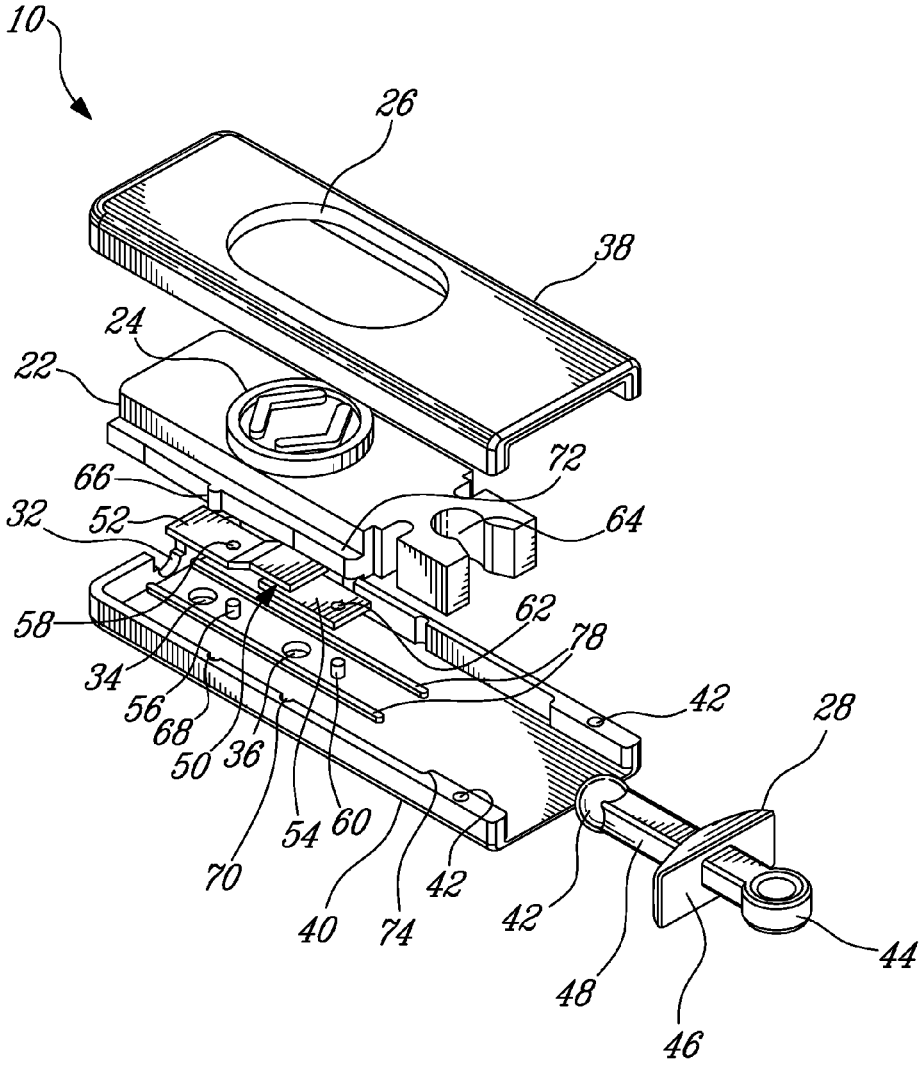
FIG. 4 is an exploded orthonormal view of the safety switch of FIG. 1 according to an illustrative embodiment of the present invention.

Referring to FIG. 4, the housing 20 illustratively comprises a top part 38 and a bottom part 40 which cooperate to enclose the actuator 22, the separable interconnection assembly 28 further comprises a ball 42, a lanyard receiving eyelet 44 and an enlarged wedge shaped portion 46 all on an elongate member 48, along with contact plates 50. The top 38 and bottom 40 parts are matingly secured to one another by pins protruding from the top part 38 (not shown) and hole joints 42 in the bottom part 40 in which the pins frictionally engage. As will be apparent to a person skilled in the art, although a pin and hole joint has been shown for illustrative purposes, any type of fastening means (e.g. fusion bonding, adhesive) suitable for securing the top part 38 and the bottom part 40 together may be used.

Still referring to FIG. 4, the contact plates 50 illustratively comprise an upper contact plate 52 connected to a first lead of the wire (reference 16 in FIG. 1) and a lower contact plate 54 connected to a second lead of the wire 16. The upper contact plate 52 is connected and secured to the bottom housing 40 via a first pin 56 of the housing which engages an aperture 58 in the upper contact plate 52. Similarly, the lower contact 54 is connected and secured to the bottom housing 40 via a second pin 60 projecting from the bottom housing 40 to engage a second aperture 62 in the lower contact plate 54. The upper contact plate 52 and the lower contact plate 54 are fitted above the water access holes 34 and 36, respectively, to facilitate water exterior to the housing 20 to enter into contact with the contacts 50.

Still referring to FIG. 4, the actuator 22 illustratively comprises a pair of opposed jaws defining a socket 64, a raised tab 66 designed to engage a first recess 68 and a second recess 70 in the wall of the bottom housing 40 and a lip 72 for abutting a stop 74 formed in the wall of the housing and thereby providing tactile feedback and limiting travel of the actuator 22 between a first retracted position and a second extended position. The actuator 22 may also comprise an additional symmetrical tab (not shown) located on the opposite side of the actuator 22 for engaging additional symmetrical recesses located in the opposite wall of the bottom housing 40. A wedge-like projection 76 (see for example FIG. 8) is further provided on the under side of the actuator 22 for engaging the upper contact plate 52 with the lower contact plate 54 as will be described herein below. A pair of rails 78 formed on the bottom part 40 for guiding the motion of the actuator 22 within the housing 20 is also provided.

Figure 5:
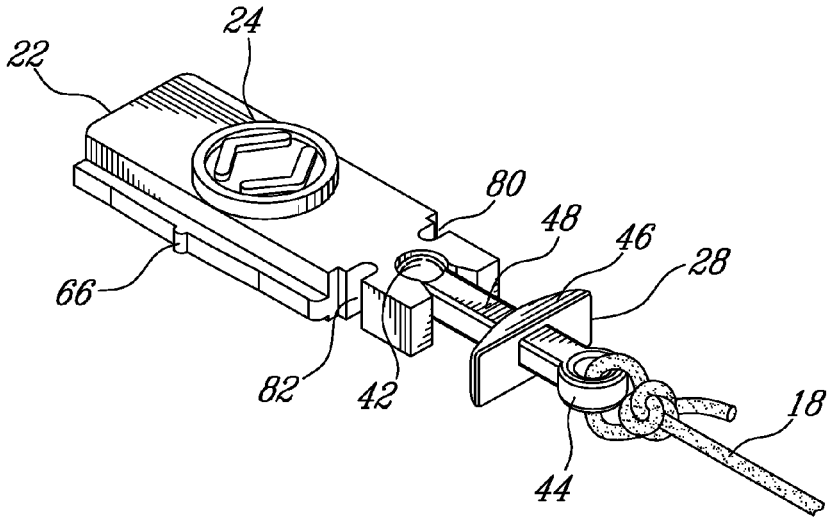
FIG. 5 is an orthonormal view of an actuator engaged with a separable interconnection assembly in accordance with an illustrative embodiment of the present invention.
Figure 6:
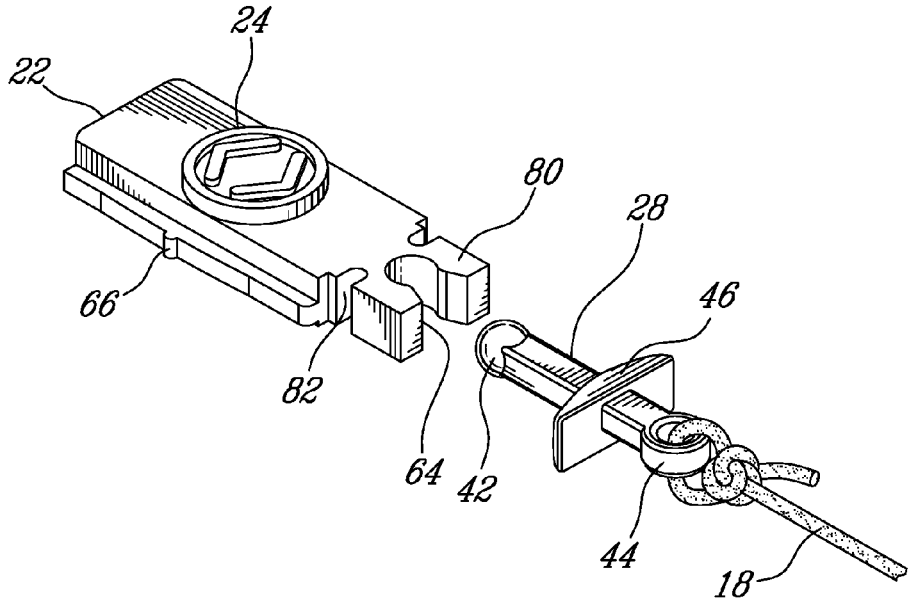
FIG. 6 is an orthonormal view of the actuator of FIG. 5 disengaged from the separable interconnection assembly.

Referring to FIGS. 5 and 6, the separable interconnection assembly 28 comprising a ball 42 is illustratively shown held snugly within the socket 64 of the actuator 22. The socket 64 comprises a resilient spring like jaw structure 80 capable of receiving and securing the ball 42 within the socket 64 and releasing the ball 42 from within the socket 64 upon application of a sufficient pulling force to the separable interconnection assembly 28. As the ball 42 is released from the socket 64, the jaws 80 defining the socket 64 deflect to allow the passage of the ball 42 from the socket 64 and resiliently return to an undeflected state thereafter. Cutaways 82 at the base of the jaws 80 facilitate the deflection thereof. While the actuator 22 comprises a socket 64 in which the ball 42 of the separable interconnection assembly 28 is engaged, it should be understood that, although the present invention is described using such a socket and ball connection, a variety of releasable mechanisms which permit the actuator 22 and separable interconnection assembly 28 to disengage upon application of a sufficient force can be used.

Figure 7:
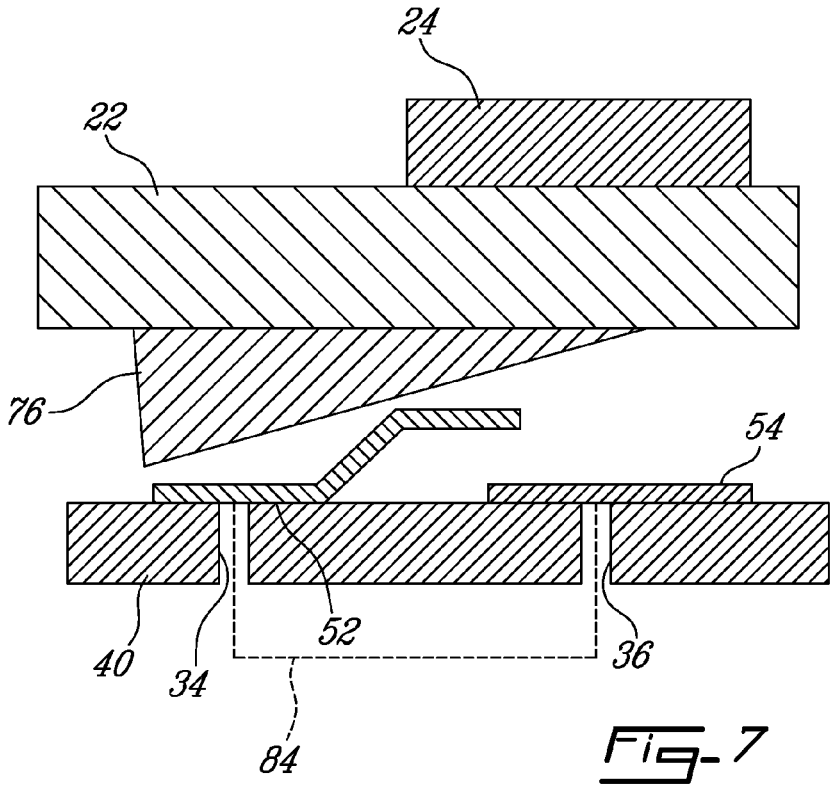
FIGS. 7 and 8 provide cross-sectional views taken along the line VII-VII in FIG. 2 illustrating the contact plates respectively in a disengaged position and in an engaged position.

Referring now to FIG. 7, a first manner for activating the switch 10 during submersion in fluid, or water, is described. This manner of activating the switch 10 provides an automatic means for establishing an electrical connection between the contact plates 50 and thus for engaging the light 14 without the need of having to manually move the actuator 22 via the thumb knob 24. In particular, in the event the water activated switch 10 is submersed in water, a conductive path, indicated by the dashed line 84, will be established via the fluid between the upper contact plate 52 and the lower contact plate 54 to thereby close the circuit between the wires leads 16, completing the electrical circuit. The holes 34, 36 in bottom part 40 of the housing 20 provide a pathway for the water to enter into contact with the plates 50 so as to form the conductive path 84. Once the electrical circuit is closed upon immersion into water, the light 14 is illuminated. Removal of the switch 10 from the water eliminates the conductive path 84 between the contact plates 50 and thus deactivates the light 14. Additionally, the holes 34, 36 are spaced far enough apart (illustratively between ½" and 1") such that the switch 10 must generally be submersed in water in order for the conductive path 84 to be completed, thereby making the switch generally impervious to activation by simple splashing, fog and spray and the like. Additionally, the housing 20 is porous enough to allow any water accumulated inside to drain quickly on removal of the switch 10 from the water following submersion.

Figure 8:
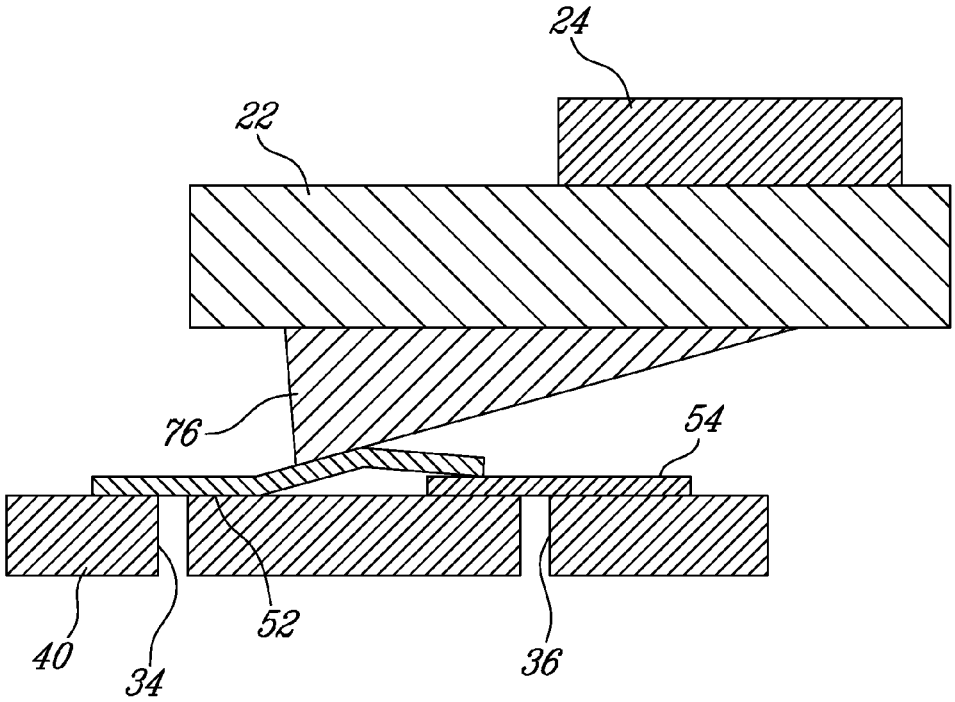

Referring now to FIG. 8 in addition to FIG. 7, a second manner for activating the switch 10 achieved by the movement of the actuator 22 will now be described. This manner of activating the switch 10 provides a manual and repetitive means for throwing the switch 10 to engage the light 14. Furthermore, this manner of activation would allow to continuously drive the light 14 for some time or indefinitely after the water activated switch 10 is removed from the water, or even if the water activated switch 10 had not been immersed and during which time a light signal is still required. In operation, application of a force to the thumb knob 24 in a direction generally indicated by the arrow as illustrated in FIG. 2 occasions the movement of the actuator 22 within the housing 20 and as guided by rails 78 from a first position (see FIG. 7) to a second position (see FIG. 8). As will now be apparent to a person of ordinary skill in the art, when the actuator 22 is in the first position, the upper contact plate 52 and the lower contact plate 54 remain physically separated by a resiliently biased upper contact plate 52 to thereby maintain the wire leads 16 in an electrically disconnected state. Referring back to FIG. 4, for example, the actuator 22 remains secured in this first position as tab 66 engages a first recess 68 in the wall of the bottom housing 40.

Referring back to FIGS. 7 and 8 in addition to FIG. 4, as the actuator 22 is moved to a second position wherein the tab 66 of the actuator 22 engages the second recess 70 in the bottom housing 40, the projection 76 is moved into contact with the upper plate 52 and forces it downwardly to physically engage the lower contact plate 54 thereby creating an electrical connection between the wire leads 16 and closing the electrical circuit. The movement of the actuator 22 to a physical position exceeding the second position will be hindered by the lip 72 located on the sides of the actuator 22 abutting the stop 74 of the housing 20. To open the switch 10, a reverse action as described herein above is undertaken. In particular, a user's thumb or finger applies a sliding force to the actuator 22 in the opposite direction as indicated by the arrow illustrated in FIG. 2 which was applied to close the switch 10. As the actuator 22 is moved to the first position wherein the tab 66 engages the first recess 68, the projection 76 disengages the upper plate 52 to relieve the downward force maintaining the upper contact plate 52 in physical contact with the lower contact plate 54. Since the upper contact plate 52 is resiliently biased to remain disengaged from the lower contact plate 54, once the downward force applied by the projection 76 is removed, the electrical circuit remains open.

Figure 9A:
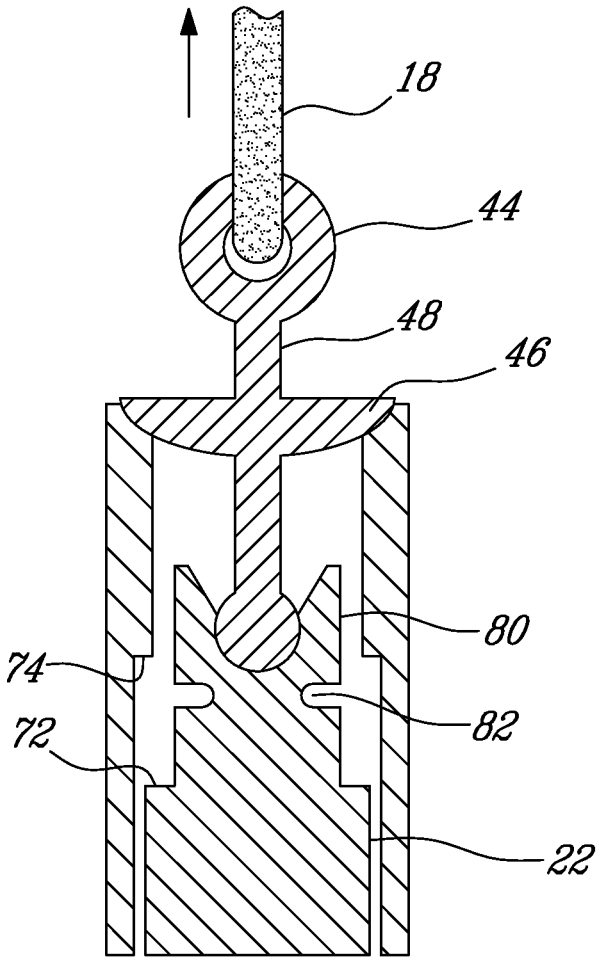
FIGS. 9A through 9E provide a partial side plan views of the safety switch of FIG. 3 with the casing removed with respectively the separable interconnection assembly engaged with the actuator in a first position, the separable interconnection assembly engaged with the actuator in a second position, the separable interconnection assembly engaged with the actuator again in a first position, the separable interconnection assembly engaged with the actuator as it transitions between a first and a second position and the separable interconnection assembly disengaged from the actuator in a second position.
Figure 9B:
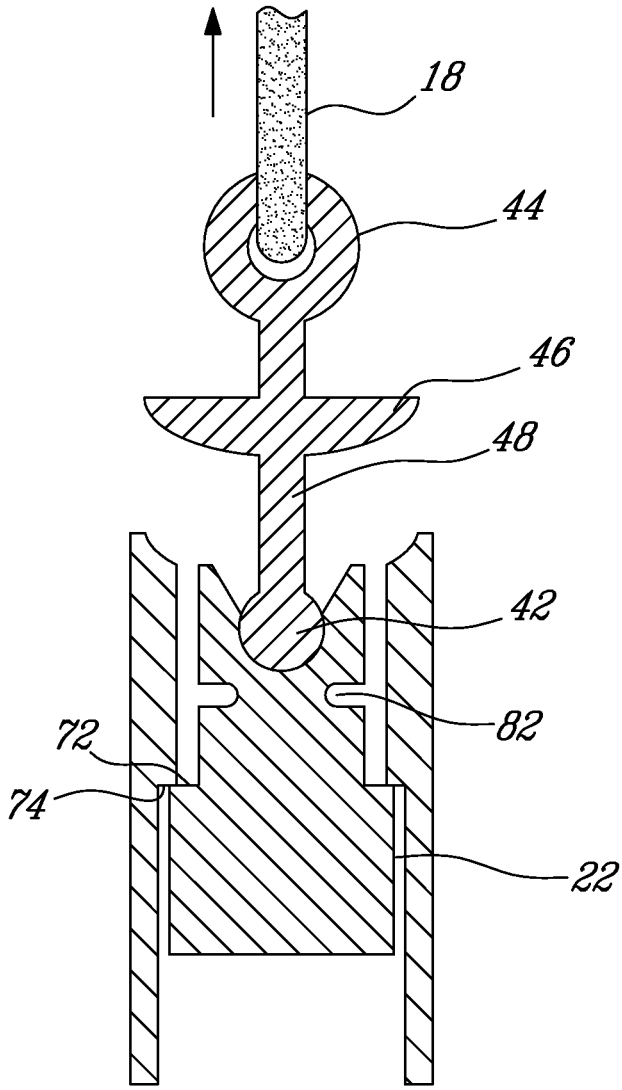

Referring now to FIG. 9A and FIG. 9B in addition to FIG. 2, a third manner for activating the switch 10 which makes use of the separable interconnection assembly 28 will now be described. The activation of the switch 10 using the separable interconnection assembly 28 generally operates by occasioning the movement the actuator 22 with a force applied to the separable interconnection assembly 28 in lieu of a force applied to the thumb knob 24. In particular, the switch 10 is activated when a sufficient force is applied to the separable interconnection assembly 28 such that the actuator 22 slides from its first position (see FIG. 7) wherein the electrical circuit is open to a second position (see FIG. 8) wherein the electrical circuit is closed. The minimum force applied to the separable interconnection assembly 28 to occasion the movement of the actuator 22 must be sufficient to disengage the tab 66 from the first recess 68 and move the actuator 22 to the second position. Any further force applied to the separable interconnection assembly 28 beyond which is required to move the actuator 22 from the first to the second position must be sufficient to cause the separable interconnection assembly 28 to disengage from the actuator 22 and exit the housing 20. To occasion the movement of the actuator 22 from the first to the second position, a force is applied to the separable interconnection assembly 28 by either pulling on the eyelet 44 or by pulling on a lanyard 18 attached to the eyelet 44 in direction generally indicated by the arrow as illustrated in FIG. 2. As a result of the separable interconnection assembly 28 drawing the actuator 22, the projection 76 will force the upper contact plate 52 and the lower contact plate 54 to engage thus creating an electrical conducting connection as described herein above. Once the actuator 22 is moved to the second position, the actuator's 22 movement will be halted when the lip 72 abuts the stop 74 in the housing 20. At this point, the pulling force on the separable interconnection assembly 28 forces the ball 42 to deflect the resilient spring like jaws 80 such that the ball 42 and thus the separable interconnection assembly 28 are released from the actuator 22 and are free to exit the housing 20. Should the separable interconnection assembly 28 be accidently pulled and disengages from the actuator 22, it may be easily reengaged by inserting the ball 42 in the socket 64 formed by the jaws 80 and forcing the separable interconnection assembly 28 in an opposite direction as generally indicated by the arrow illustrated in FIG. 2 until the actuator 22 moves from the second position to the first position.

Figure 9C:
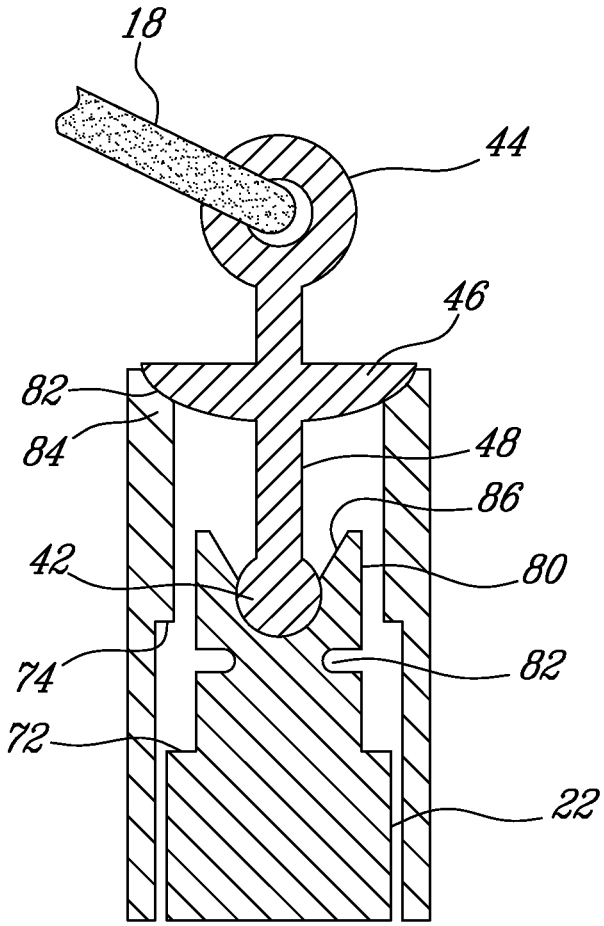
Figure 9D:
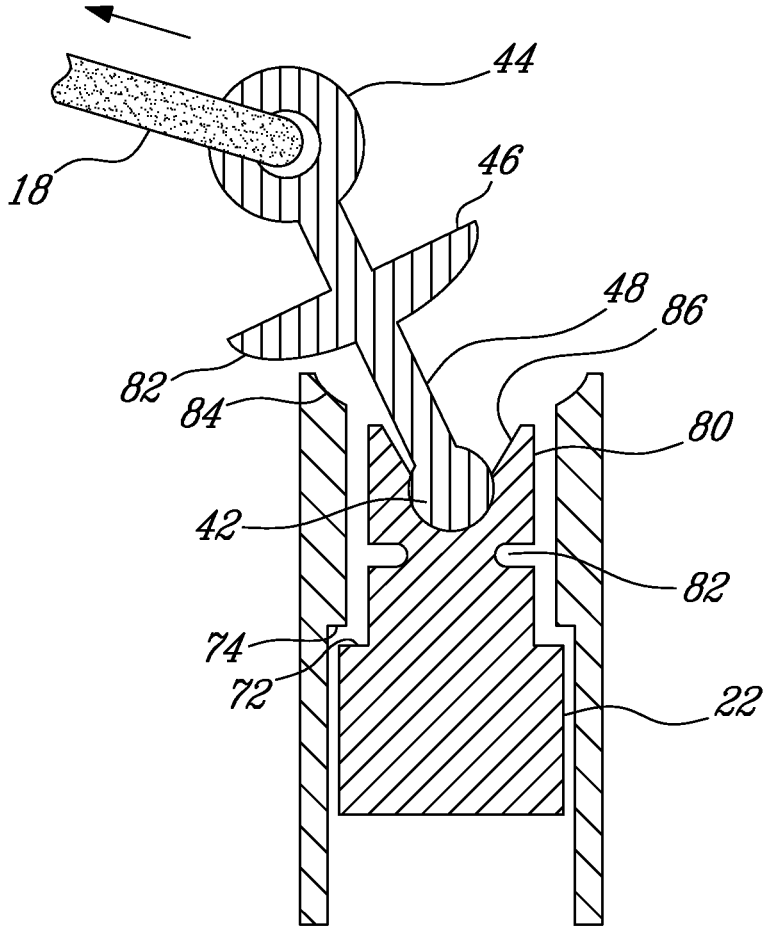
Figure 9E:
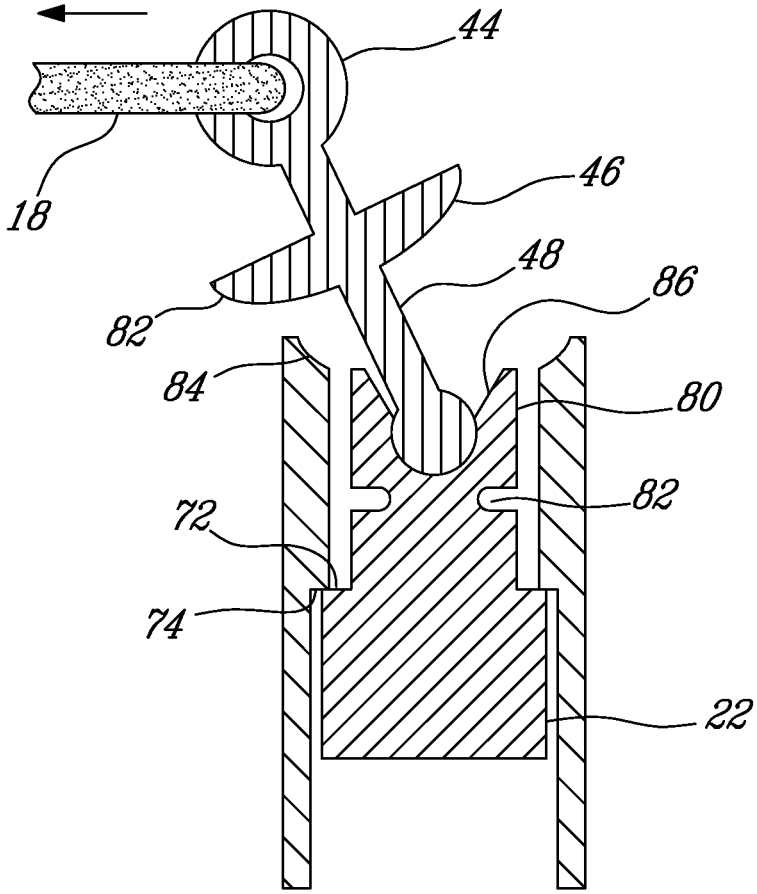

Referring now to FIG. 9C, FIG. 9D and FIG. 9E the separable interconnection assembly 28 is advantageously designed to prevent the jamming of the separable interconnection assembly 28 within the housing 20 when a force substantially at an angle to an axis of the separable interconnection assembly 28 is applied to the separable interconnection assembly 28. To allow for the application of an oblique pulling force on the separable interconnection assembly 28, the wedge like portion 46 is designed to have curved surfaces 82 which correspondingly mate with the surfaces of a seat 84 formed towards the end of the housing 20. As will now be apparent to a person of ordinary skill in the art, the curved edges 82 allow the wedge like portion 46 to slide along the opposing surfaces of the seat 84 when an oblique force is applied to the separable interconnection assembly 28. Similarly, to prevent the jamming of separable interconnection assembly 28 within the socket 64, angled walls 86 of the jaws 80 similarly permit a radial movement of the elongate member 48 as the separable interconnection assembly 28 is pulled at an oblique angle thereby preventing the elongate member 48 from jamming within the jaws 80.

Although the present invention has been described hereinabove by way of specific embodiments thereof, it can be modified, without departing from the spirit and nature of the subject invention as defined in the appended claims.

We claim:

1. A safety device for attachment to a flotation device comprising:

a light source;

a housing;

an actuator mounted within said housing and slideable between a first position wherein said light source is not illuminated and a second position wherein said light source is illuminated, said actuator further comprising a raised boss engageable from outside of said housing;

a lanyard at least a portion of which is outside of said housing, said lanyard releasably connected to an end of said actuator using a separable interconnection assembly; and a water activated switch wherein when the device is submerged in water, said water activated switch completes an electrical circuit illuminating said light source;

wherein when said lanyard is pulled, said actuator moves from said first position to said second position and on reaching said second position said separable interconnection assembly separates thereby disengaging said lanyard from said actuator and an electrical circuit is completed illuminating said light source, and wherein said actuator may be reversed from said second position back into said first position using said raised boss thereby extinguishing said light source.

2. The device of claim 1, wherein said water activated switch is within said housing and further wherein said housing comprises a plurality of holes formed therein, said holes allowing water to infiltrate when the device is submerged in water and drain when the device is subsequently removed from water.

3. The device of claim 2, wherein said water activated switch is substantially unaffected by splashing, fog and spray.

4. The device of claim 1, wherein said electrical circuit comprises a battery.

5. The device of claim 1, wherein said raised boss comprises a knob having an upper surface sized to receive a user's thumb and profiled to provide increased friction between the user's thumb and the upper surface.

6. The device of claim 1, wherein said light source comprises at least one LED.

7. The device of claim 1, wherein said separable interconnection assembly comprises a ball and socket type assembly allowing said lanyard to be reunited with said actuator through insertion of said ball into said socket thereby allowing the safety device to be reset following use.

8. The device of claim 6, wherein said ball is mounted to a first end of an elongate member, an eyelet is mounted to a second end of said elongate member and wherein said actuator comprises a pair of opposed jaws defining said socket such that when said ball and socket type assembly is assembled said ball is held snugly between said jaws.

9. The device of claim 7, wherein said eyelet extends beyond a first end of said housing when said actuator is in said first position, said lanyard attached to said eyelet.

10. The device of claim 8, wherein said elongate member comprises an enlarged wedge shaped portion towards a middle thereof and said housing comprises a seat formed in said first end and configured to receive said wedge shaped portion when said ball is held between said jaws and said actuator is in said first position, said wedge shaped portion facilitating sliding of said actuator into said second position when said lanyard is pulled at an angle to an axis of said elongate member.

11. The device of claim 9, wherein said wedge shaped portion and said seat comprise complementary arcuate surfaces.

12. A safety device for attachment to a flotation device comprising:

a light source;

a housing;

an actuator mounted within said housing and slideable between a first position wherein said light source is not illuminated and a second position wherein said light source is illuminated, said actuator further comprising a raised boss engageable from outside of said housing;

a lanyard at least a portion of which is outside of said housing, said lanyard releasably connected to an end of said actuator using a separable interconnection assembly; and a water activated switch, said water activated switch for illuminating said light source when the device is submersed in water;

wherein when said lanyard is pulled, said actuator moves from said first position to said second position and on reaching said second position said separable interconnection assembly separates thereby disengaging said lanyard from said actuator and an electrical circuit is completed illuminating said light source, and wherein said actuator may be reversed from said second position back into said first position using said raised boss thereby extinguishing said light source.

13. The device of claim 12, wherein said water activated switch is within said housing and further wherein said housing comprises a plurality of holes formed therein, said holes allowing water to infiltrate when the device is submersed in water and allowing water to drain following removal of the device from water.

14. The device of claim 12, wherein said light source comprises at least one LED.

* * * * *